United States Patent [19]

Weber et al.

[11] 4,280,408

[45] Jul. 28, 1981

[54] PROJECTILE

[75] Inventors: Adolf Weber, Neunkirchen; Siegfried Rhau, Nuremberg; Utz-Udo Ahlers, Diepersdorf, all of Fed. Rep. of Germany

[73] Assignee: Diehl GmbH & Co., Fed. Rep. of Germany

[21] Appl. No.: 42,248

[22] Filed: May 24, 1979

[30] Foreign Application Priority Data

Jun. 6, 1978 [DE] Fed. Rep. of Germany ..... 2824703

[51] Int. Cl.[3] ..... F42B 11/14

[52] U.S. Cl. ..... 102/501; 102/516; 102/364; 102/475

[58] Field of Search ..... 102/6, 66, 90, 52, 92.1-92.7

[56] References Cited

U.S. PATENT DOCUMENTS

| | | | |
|---|---|---|---|
| 1,312,763 | 8/1919 | Strang | 102/52 |
| 2,435,095 | 1/1948 | Nichols | 102/52 |
| 2,801,590 | 8/1957 | Balke et al. | 102/66 X |

FOREIGN PATENT DOCUMENTS

| | | | |
|---|---|---|---|
| 1578115 | 4/1971 | Fed. Rep. of Germany | 102/52 |

*Primary Examiner*—Harold J. Tudor

*Attorney, Agent, or Firm*—Scully, Scott, Murphy & Presser

[57] ABSTRACT

A projectile with a penetrating member, in which a pyrotechnic composition is arranged ahead of and rearwardly of the penetrating member. The forward composition, preferably incendiary, is encompassed by a ballistic hood, the rearward composition being at least partially of explosive material is detonatable by an impact detonator. The head portion of the penetrating member is formed of two regions having different slopes to increase the activity of the projectile at flat striking angles against a target. The two regions are separated by a sharp-edged gripping edge. The penetrating member may also include in the interior thereof a plug of a pyrophorically acting metal or alloy.

9 Claims, 1 Drawing Figure

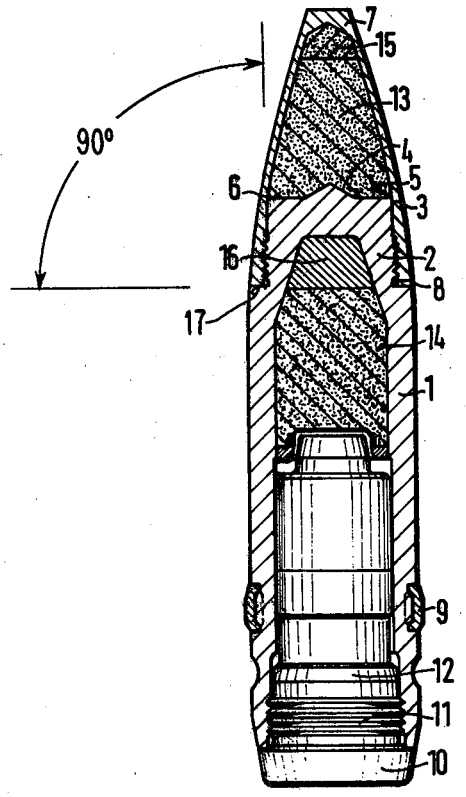
90°
7
15
13
4
5
3
6
16
2
8
17
14
1
9
12
11
10

PROJECTILE

BACKGROUND OF THE INVENTION

1. Field of the Invention

The present invention relates to a projectile including a penetrating member having a frontal area and a head portion fairing into the shell surface of the outer projectile configuration; including a pyrotechnical composition, preferably an incendiary composition, adapted to be detonated upon impact against a target and which is arranged within a ballistic hood ahead of the penetrating member; and a second pyrotechnic composition consisting at least partially of an explosive material and which is detonatable through the intermediary of an impact detonator, and arranged in an interior recess or hollow of the penetrating member.

2. Discussion of the Prior Art

A projectile of the above mentioned type is known from German Laid-open Patent Application 25 52 950. This known projectile pertains to an incendiary projectile which at impact against armored or unarmored, multiple compartmented targets will propagate an incendiary effect on the target surface as well as interiorly of the target, in conjunction with a fragmentation effect. The detonation of the second pyrotechnic composition which is arranged in the penetrating member is thereby initiated by means of a base detonator which is formed as an impact detonator.

The hardened penetrating member which is provided in the case of this known projectile, preferably for the combating of armored targets evidences a tip constituted of two conically shaped regions wherein the generating angle of the outer cone section is smaller than the generating angle at the tip of the penetrating member. The second pyrotechnic composition which is located interiorly of this member, and which at least partially consists of explosive material, is detonated at target impact by the base detonator, thus causing the penetrating member to burst. The resultantly produced splinters or fragments penetrate further into the interior of the target, together with a portion of the pyrotechnic composition.

In the combating of rapidly moving target objects, in particular of aircraft, as a rule, the majority of projectiles strike the target at relatively low impact angles. When, for this purpose, there are employed projectiles which evidence the previously described shape, it can happen that although the ballistic hood will be destroyed, the penetrating member will merely be deflected from its trajectory, in effect, that it will ricochet off the target surface. Since the projectile is hereby not sufficiently intensely decelerated, the impact detonator will not respond and the projectile remains thus almost completely ineffective.

SUMMARY OF THE INVENTION

Accordingly, it is an object of the present invention to so construct a projectile of the above-mentioned type that even for low impact or striking angles at which the penetrating member initially does not penetrate the outer wall of the target object will still be assuredly detonated, but at the same time, for an almost perpendicular impact, will develop its optimum effect.

A further object of the present invention is to so construct the projectile that even at low impact angles, the detonation of the impact detonator actuated exteriorly of the target, there will be achieved the greatest possible effect on the target object.

In order to achieve the foregoing principal object, in the frontal area of the head portion which is constituted of two surfaces having differing slopes, the inner surface evidences the smaller generating angle, and the outer surface which evidences the larger generating angle and preferably extends perpendicular to the projectile axis is set back from the shell surface of the head portion by a sharp-edged gripping edge.

In order to attain this further object, it is also advantageous that the head portion of the penetrating member be so constructed interiorly thereof as to be suitable for the receiving of a solid, plug-shaped insert of a pyrophorically acting metal, as well as also the exclusive utilization of explosive material in the second pyrotechnic composition.

The sharp-edged termination of the frontal area of the penetrating member at an impact under a low striking angle inhibits a possible sliding of the penetrating member along the target surface which would lead to a ricochet. In contrast therewith, the projectile is rotated into the target about the gripping edge, however, at least extensively braked so that in each case there will take place the required deceleration for the response of the impact detonator and the second pyrotechnic composition will be detonated. Afforded thereby is that, even in the instances in which the impulse components of the penetrating member perpendicular to the target surface are not adequate for penetration into the latter, due to the disintegration of the penetrating member at the detonation of the second pyrotechnic composition, this will lead to a significent effect on the target.

On the other hand, the conically shaped tip which is provided on the frontal area of the penetrating member will prevent the deceleration from becoming so great at an approximately perpendicular target impact as to lead to an immediate uncontrolled deflagration of the explosive material contained in the pyrotechnic composition. Since the greatest possible fragmentation effect is only obtained when the fragments are additionally accelerated by the detonation front of the pyrotechnic composition arranged in the penetrating member in the direction towards the target object, for this purpose there is necessary a controllable detonation from the projectile base, meaning in this instance from the base detonator. This would no longer be afforded at a deflagration of the explosive material, as can occur at an excessively hard, in essence not a timewise expanded impact.

The advantageous correlation between the greatest possible response capability at flat striking angles and an optimum effectiveness development of the projectile at an approximately perpendicular impact is obtained when the inner surface substends a generating angle of about 150°, and its diameter at the base surface thereof corresponds to about half the diameter of the frontal area of the penetrating member, and when the outer surface subtends an angle of about 90° with the shell surface. Hereby, within the scope of the invention it is also possible to contemplate significantly smaller angles, in essence an acute-angled construction of the gripping edge which will additionally improve the gripping action. This gripping action, particularly at extremely flat striking angles, can also be additionally enhanced in that a preset rupturing location which separates the set-back head portion from the remaining penetrating member is so constructed as a sharp-edged recess, that this will produce an additional gripping edge which becomes effective particularly at these low striking angles. Also in this instance is it within the scope of the invention that this gripping edge be formed at an acute angle.

In that the penetrating member is adapted to receive in the interior of its head portion a plug of zirconium or another pyrophorically acting metal, during a detonation of the second pyrotechnic composition exteriorly of the target object as a result of an extremely flat striking angle, additional metal fragments are propelled into the interior of the target object. Consequently, within the target interior there is produced not only a fragmentation effect but, concurrently, there is achieved an extensive incendiary effect. In order to cause the effective range of these fragments to be as large as possible it is, moreover, advantageous when the second pyrotechnic composition is constituted exclusively of explosive material.

Finally, inasmuch as the separating location between the insert of pyrophorically active metal and the second pyrotechnic composition is located in the immediate proximity to the transition location, not only is there propagated the disintegration of the penetrating member and the in depth effect of the projectile but there concurrently is created the capability of also an effect of the zirconium on the target surface.

BRIEF DESCRIPTION OF THE DRAWING

Further details of the invention can now be ascertained from the following description of a preferred embodiment thereof taken in conjunction with the single FIGURE of the accompanying drawing illustrating a longitudinal section through a projectile constructed pursuant to the invention.

DETAILED DESCRIPTION

The projectile includes a penetrating or piercing member 1 which is constructed as a hollow body whose head portion 2 consists of a frontal area and a shell or cartridge surface 3 fairing into the outer projectile shape. The frontal area of the head portion 2, in the illustrated embodiment is constituted of the assembly of an inner conically tapered surface 4 and an outer surface 5 extending generally perpendicular to the projectile axis. The last-mentioned surface 5, in this embodiment, is set back from the shell surface 3 by an approximately right-angled gripping edge 6. The inclination of the inner surface 4 measures about 75° with respect to the projectile axis, its diameter at the base corresponds to about one-half the diameter of the frontal area. The surface 5, in addition to the herein illustrated perpendicular orientation relative to projectile axis, can be inclined either inwardly or outwardly with regard to this axis. Furthermore, the surfaces 4 and 5 can also incorporate curvatures in addition to the herein illustrated planar surface. It is important in this case that in each instance herein there be maintained the sharp gripping edge 6.

The head portion 2 which is set back with respect to the remaining penetrating member further evidences a preset rupturing location 8 formed as an annular recess which, concurrently, serves as a fastening groove for a projectile hood 7. This is also set back sharp-edged from the shell surface of the penetrating member so as to produce a kind of second gripping edge 17. The projectile is provided with a guide ring 9 and, rearwardly, closed off with a base screw 10, 11. This base screw 10, 11 is a component of a base detonator 12 which is screwed rearwardly into the projectile, in essence into the penetrating member 1. The hood 7 and the penetrating member 1 each respectively contain a pyrotechnic composition 13 and 14. Herein the pyrotechnic composition 13 arranged under the hood consists of an incendiary composition and for the detonation thereof can additionally include a primer charge 15. The pyrotechnic composition 14 arranged in the penetrating member 1, in the illustrated embodiment, consists exclusively of explosive material. Ahead thereof there is additionally arranged a solid insert 16 in the form of a plug of a pyrophorically acting metal, in this instance, zirconium. The separation location between the pyrotechnic composition 14 and the insert 16 is herein located in the immediate proximity to the rupturing location 8.

When this projectile strikes against an armored or multiple bulk-headed or compartmented target with a relatively flat impact angle, the ballistic hood 7 is initially destroyed and the pyrotechnic composition 13 which is arranged therebelow is detonated so as to cover at least the target surface with fire. The essentially fired gripping edge 6 will, after the bursting of the hood 7, prevent sliding of the penetrating member 1 along the target surface and thus provides the necessary deceleration required for the detonation of the base detonator 12. The second pyrotechnic composition 14 which is arranged in the penetrating member 1, in this instance an explosive material, is accordingly brought to detonation in close proximity to the target whereby a portion of the fragments of the penetrating member 1 as well as the solid insert 16 will penetrate into the target, possibly also with the pulling along of portions of the burning pyrotechnic composition 13. Thus, obtained even under extremely flat striking angles is a still significant effect on the target.

For large striking angles, in particular at an almost perpendicular impact, the tip 4, on the one hand, prevents a too strong impact of the penetrating member which would cause a shock-like conversion of the explosive material contained in the pyrotechnic composition 14 without the formation of a detonation front. Through the timewise expansion of the braking cycle attained by the tip 4, such a deflagration is prevented while concurrently, through the produced deceleration there is detonated the base detonator 12 which, in turn, will detonate the pyrotechnic composition 14 from the base of the projectile. Produced in this manner is a directed detonation front which additionally accelerates the fragments of the penetrating member 1 and the insert 16 in a direction towards the target object and thus leads to the greatest possible fragmentation effect.

What is claimed is:

1. An antiaircraft projectile having a ballistic projectile hood (7) and a first pyrotechnic composition (13) with a primer charge (15) arranged below said hood, a penetrating member (1) which is open at its base and having two gripping edges (6, 17) at the outer circumference of cylindrical sections (1, 2) a base detonator (12) for a second pyrotechnic composition (14) arranged in said penetrating member (1), and an insert (16) located in the head portion of said penetrating member (1) formed of metallic zirconium.

2. Projectile as claimed in claim 1, said first pyrotechnic composition comprising an incendiary composition, and said second pyrotechnic composition at least partially comprising an explosive material.

3. Projectile as claimed in claim 1 or 2, said penetrating member including a head portion forming a shell surface fairing into the outer projectile configuration, the frontal area of said head portion including inner and outer surfaces having different slopes, the inner surface having a larger generating angle, said outer surface extending approximately perpendicular to the projectile axis.

4. Projectile as claimed in claim 3, said inner surface subtending a generating angle of about 150° and having a diameter at the base surface thereof of about one-half the diameter of the frontal area of said penetrating member, said outer surface subtending an angle of about 90° with the shell surface.

5. Projectile as claimed in claim 1, said penetrating member including a head portion forming a shell surface fairing into the outer projectile configuration, said head portion having a smaller diameter than the remaining penetrating member and being separated therefrom by a preset rupturing location consisting of a sharp-edged recess.

6. Projectile as claimed in claim 5, said head portion of the penetrating member including a hollow; and a solid plug-shaped insert of a pyrophorically acting metal being arranged in said hollow.

7. Projectile as claimed in claim 6, said solid insert being constituted of a pyrophorically acting metal alloy.

8. Projectile as claimed in claim 2, said second pyrotechnic composition being exclusively constituted of explosive material.

9. Projectile as claimed in claim 6, wherein the separating location between said pyrophorically acting metal insert and said second pyrotechnic composition is located in immediate proximity to the preset rupturing location.

* * * * *